US008691484B2

(12) United States Patent
Nozaki et al.

(10) Patent No.: US 8,691,484 B2
(45) Date of Patent: Apr. 8, 2014

(54) TONER AND METHOD FOR PRODUCING THE SAME, TONER CONTAINER, DEVELOPER, IMAGE FORMING APPARATUS AND PROCESS CARTRIDGE

(75) Inventors: Tsuyoshi Nozaki, Ikeda (JP); Chiyoshi Nozaki, Otsu (JP); Atsushi Yamamoto, Kawanishi (JP); Mitsuyo Matsumoto, Ibaraki (JP); Takuya Kadota, Kobe (JP); Katsunori Kurose, Takarazuka (JP); Yoshimichi Ishikawa, Itami (JP)

(73) Assignee: Ricoh Company, Ltd., Tokyo (JP)

( * ) Notice: Subject to any disclaimer, the term of this patent is extended or adjusted under 35 U.S.C. 154(b) by 959 days.

(21) Appl. No.: 12/046,784

(22) Filed: Mar. 12, 2008

(65) Prior Publication Data

US 2008/0233510 A1 Sep. 25, 2008

(30) Foreign Application Priority Data

Mar. 19, 2007 (JP) ..... 2007-069945

(51) Int. Cl.
*G03G 9/087* (2006.01)

(52) U.S. Cl.
USPC ..... 430/108.8; 430/111.4; 430/137.14; 430/108.2; 430/108.1

(58) Field of Classification Search
USPC ..... 430/108.8, 111.4, 137.14, 108.1, 108.2
See application file for complete search history.

(56) References Cited

U.S. PATENT DOCUMENTS

2006/0040194 A1* 2/2006 Sugiura et al. ..... 430/108.4
2006/0172220 A1* 8/2006 Patel et al. ..... 430/137.14
2006/0204882 A1 9/2006 Nozaki et al.
2006/0210902 A1 9/2006 Nakamura et al.
2006/0275686 A1 12/2006 Kadota et al.
2007/0026335 A1 2/2007 Yamamoto et al.
2007/0059625 A1 3/2007 Yamamoto et al.
2007/0059626 A1* 3/2007 Inoue et al. ..... 430/108.8
2007/0160923 A1* 7/2007 Matsumoto et al. ..... 430/108.1
2007/0166635 A1 7/2007 Yamamoto et al.
2007/0190442 A1 8/2007 Nakamura et al.
2007/0196756 A1* 8/2007 Shibai et al. ..... 430/108.1

(Continued)

FOREIGN PATENT DOCUMENTS

JP 10-20549 1/1998
JP 2003-515795 5/2003

(Continued)

OTHER PUBLICATIONS

Poth Hille & Co Ltd, http://www.poth-hille.co.uk/products/paraffin-wax, England, 2009.*

(Continued)

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

Disclosed is a non-magnetic toner for use in developing electrostatic toner image, wherein the toner is produced by a toner production method that includes: dispersing in an aqueous medium an organic dispersion liquid that comprises in an organic solvent a pigment, a binder resin and/or a binder resin precursor, and a releasing agent; removing the organic solvent to prepare a dispersion slurry in which toner particles are dispersed in the aqueous medium; heating the dispersion slurry to a temperature equal to or higher than the melting point of the releasing agent; and washing the toner particles.

5 Claims, 1 Drawing Sheet

(56) References Cited

U.S. PATENT DOCUMENTS

| | | | | |
|---|---|---|---|---|
| 2007/0207399 | A1 | 9/2007 | Kadota et al. | |
| 2007/0218383 | A1 * | 9/2007 | Seshita et al. | 430/108.1 |
| 2007/0218384 | A1 | 9/2007 | Matsumoto et al. | |
| 2007/0218388 | A1 | 9/2007 | Kurose et al. | |
| 2007/0218393 | A1 | 9/2007 | Nozaki et al. | |
| 2007/0238042 | A1 | 10/2007 | Yasunaga et al. | |
| 2008/0038656 | A1 | 2/2008 | Yasunaga et al. | |

FOREIGN PATENT DOCUMENTS

| | | | |
|---|---|---|---|
| JP | 2005-49858 | | 2/2005 |
| JP | 2006-106710 | | 4/2006 |
| JP | 2006-113553 | | 4/2006 |
| JP | 2006-227592 | | 8/2006 |
| JP | 2006-243301 | | 9/2006 |
| WO | WO 01/40878 | A1 | 6/2001 |

OTHER PUBLICATIONS

Office Action issued Apr. 26, 2011, in Japanese Patent Application No. 2007-069945.

* cited by examiner

TONER AND METHOD FOR PRODUCING THE SAME, TONER CONTAINER, DEVELOPER, IMAGE FORMING APPARATUS AND PROCESS CARTRIDGE

BACKGROUND OF THE INVENTION

1. Field of the Invention

The present invention relates to a non-magnetic toner for use in developing electrostatic images, a developer using the toner, a toner container and an image forming apparatus.

2. Description of the Related Art

As a method for fixing toner, a contact heat fixing method such as a heat roller fixing method has hitherto been widely adopted. A fixing apparatus used in the heat roller fixing method is equipped with a heat roller and a pressure roller, and by making a recording sheet carrying a toner image pass through a pressure contact section (nip section) between the heat roller and the pressure roller, the fixing apparatus melts the toner image to be fixed on the recording sheet.

In the contact heat fixing method typified by the heat roller fixing method, fixing is carried out by bringing the surface of a heating member (for example, a heat roller) of a contact heat fixing apparatus into contact with a toner image on a recording sheet, and hence sometimes there occurs an offset phenomenon that a portion of the toner image is partially adhered to the heating member, and the adhered toner image is transferred to a successive recording sheet to stain the successive recording sheet. Accordingly, in the contact heat fixing method typified by the heat roller fixing method, it is necessary to prevent the above-described offset phenomenon.

There has been known techniques in which, for the purpose of preventing the offset phenomenon, a fixing oil such as silicone oil is applied to or impregnated into the heat roller or the pressure roller of a fixing apparatus. However, from the viewpoint of downsizing of fixing apparatuses and cost reduction, oilless fixing apparatuses in which a fixing oil imparting mechanism is omitted and fixing apparatuses of the types that reduce oil application amounts have been adopted. When such fixing apparatuses are adopted, the toner is added with a releasing agent as offset preventing agent.

Additionally, in the case of the heat fixing methods, the heating temperature is preferably as low as possible for the purpose of energy saving; however, if the thermal properties of the binder resin included in the toner is designed to be compatible with too low temperatures in order to attain low-temperature fixability, the heat-resistance/storage stability of the toner is degraded, and there occur problems such as blocking. For the purpose of making the low temperature fixability and the heat-resistance/storage stability compatible with each other, it is advantageous to use polyester resin as the binder resin. Polyester resins have lower viscosity and higher elasticity than vinyl copolymer resins and hence offer excellent low temperature fixability and heat-resistance/storage stability.

Recently, there have been known polymerization methods and methods for producing new toners, namely, chemical toners so as to replace conventional pulverization methods; among these is a so-called dissolution suspension method as a toner production method that is suitable for using polyester resin. When this method is used, the circularity of the toner tends to be high so as for the toner to be approximately spherical, and the toner can also be made nonspherical.

As is generally known, the toner shape closer to sphere is advantageous in the sense that its transferability is improved and accordingly the image quality is also improved. However, it is difficult to transfer all of such spherical toner particles, and toner particles remaining on the photoconductor and other members need to be removed. However, the conventional blade cleaning method suffers from a disadvantage that spherical toners tend to slip through the blade to cause problems. Accordingly, there have been devised methods in which, without adopting daring application of blade cleaning to spherical toners, toners are recovered in the developing unit or the like, or dispersed with brushes or the like (referred to as a so-called cleanerless system). The use of such a system provides advantageous effects, including smaller image forming apparatus accomplished by absence of toner box or the like, and reduced waste toner amount. Additionally, for the purpose of using such a system, it is important to reduce the amount of the remaining untransferred toner as much as possible, and for that purpose, it is essential to increase the sphericity of the toner so as to improve its transferability.

Additionally, when a toner containing a sufficient amount of releasing agent is produced by using the above-described solution suspension method, it is often the case that the releasing agent is exposed to the toner surface and, in some cases, stains the developing members. The releasing agent can also be embedded deeply in the interior of the toner; however, when the releasing agent is too deeply embedded, bleeding of the releasing agent upon fixation becomes insufficient, leading to generation of offset.

Additionally, Japanese Patent Application Laid-Open (JP-A) No. 2006-227592 discloses a technique for providing a toner having stable charge characteristics even when the dot reproducibility, developability and transferability are improved by reducing the particle size and by making the particles spherical, by controlling the temperature of the medium used in the cleaning step to a specified range.

Additionally, JP-A No. 2006-113553 describes an invention on an image forming apparatus capable of obtaining images of high quality. This invention is directed to an image forming apparatus including a developing apparatus and a cleaning member that removes the substances remaining on the surface of the image bearing member after the toner image has been transferred onto the recording sheet, wherein the above-described developing apparatus contains toner base particles including a binder resin and a colorant, and contains resin particles in which fine particles of a compound having an acid-accepting effect are included in such condition that the fine particles of the compound are partially exposed to the surface of the resin particles.

JP-A No. 2005-49858 discloses an invention on a resin particle for use in a toner, satisfactory in blade cleaning property and excellent in low temperature fixability and anti-hot offset property.

Japanese Patent Application Laid-Open (JP-A) 2003-515795 describes an invention on compounds useful as a charge adjusting agent for a toner for use in electrophotography.

BRIEF SUMMARY OF THE INVENTION

The present invention has been accomplished for the purpose of solving the above-described problems pertinent in the art, and an object of the present invention is to provide: a non-magnetic toner for use in developing electrostatic toner image, wherein the non-magnetic toner is sufficient in chargeability and excellent in the durability of the chargeability, and makes compatible low temperature fixability with heat-resistance/storage stability; a method for producing the toner; a developer using the toner; a toner container; an image forming apparatus; and a process cartridge.

The means for solving the above-describe problems are as follows.

(1) A toner production method including: dispersing in an aqueous medium an organic dispersion liquid that comprises in an organic solvent a pigment, a binder resin and/or a binder resin precursor, and a releasing agent; removing the organic solvent to prepare a dispersion slurry in which toner particles are dispersed in the aqueous medium; heating the dispersion slurry to a temperature equal to or higher than the melting point of the releasing agent; and washing the toner particles.

(2) The toner production method according to (1), wherein the dispersion slurry comprises a surfactant.

(3) The toner production method according to (2), wherein the surfactant is one of a monovalent anionic surfactant and a divalent anionic surfactant.

(4) The toner production method according to any one of (1) to (3), wherein the releasing agent is one of a paraffin wax and a polyethylene wax.

(5) The toner production method according to any one of (1) to (4), wherein the binder resin comprises two or more different binder resins, and comprises a modified polyester resin comprising urethane or/and urea groups.

(6) The toner production method according to (5), wherein the polyester resin comprises a modified polyester resin component extended in chain length or/and crosslinked by a reaction of an amine and a modified polyester resin having an isocyanate group at a terminal thereof.

(7) A toner produced by the toner production method according to any one of (1) to (6), wherein the peak intensity ratio R of a peak derived from the polyester skeleton (bisphenol derivative) to the peak derived from the releasing agent (ethylene chain) as measured with ATR-IR method satisfies the relation $0.03<R<0.1$, and wherein the endothermic amount H of the releasing agent in the toner as measured with the DSC method satisfies the relation 3 mJ/mg<H<7 mJ/mg.

(8) The toner according to (7), wherein the toner satisfies the relation $1 \geq H2/H1 \geq 0.9$, where H1 is an endothermic amount of the releasing agent contained in the toner as measured by the DSC method, and H2 is an endothermic amount of the releasing agent contained in the toner as measured by the DSC method, the toner used for measurement of H2 being prepared by dispersing the toner in a 10% by mass aqueous solution of sodium laurylsulfate to a toner dispersion concentration of 10% by mass to prepare a dispersion liquid by maintaining the dispersion liquid at a temperature higher than the melting point of the releasing agent by 10° C. or more for 10 hours followed by sufficient washing and drying.

(9) A toner container including the toner according to one of (7) and (8).

(10) A developer including the toner according to one of (7) and (8).

(11) An image forming apparatus using the developer according to (10).

(12) The image forming apparatus according to (11), wherein a roller is used as a fixing member.

(13) The image forming apparatus according to one of (11) and (12), wherein the fixing member is not coated with oil.

(14) A process cartridge including a photoconductor and at least one unit selected from a charging unit configured to charge the photoconductor, a developing unit, and a cleaning unit, wherein the process cartridge is detachably mounted to a main body of the image forming apparatus according to any one of (11) to (13).

According to the present invention, it is possible to provide a toner that causes no stains upon development and has a sufficient, durable chargeability, by the method that comprises the steps of granulating a toner that contains a sufficient amount of releasing agent moderately localized in the vicinity of the toner surface, heating the toner to a temperature higher than the melting point of the releasing agent so that the releasing agent exposed to the toner surface is dispersed in the aqueous medium by the action of surfactant, and washing and drying the toner.

DETAILED DESCRIPTION OF THE INVENTION

Figure 1:
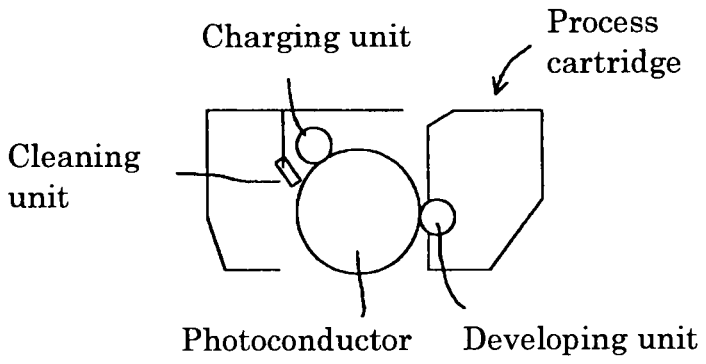
FIG. 1 is a schematic view illustrating the configuration of an image forming apparatus using a process cartridge according to the present invention.

Hereinafter, the structure of the present invention will be described. The present invention will be described by way of preferred embodiments, which however shall not be construed as limiting the scope of the present invention. It will be understood that alternative embodiments can be made and additions, modifications, deletions to the preferred embodiments may be made within the scope of one skilled in the art, and that any of the embodiments falls within the scope of the present invention as long as the operation and advantageous effect of the present invention are provided.

The present invention is as described below.

(1) A toner production method including: dispersing in an aqueous medium an organic dispersion liquid that comprises in an organic solvent a pigment, a binder resin and/or a binder resin precursor, and a releasing agent; removing the organic solvent to prepare a dispersion slurry in which toner particles are dispersed in the aqueous medium; heating the dispersion slurry to a temperature equal to or higher than the melting point of the releasing agent; and washing the toner particles.

(2) The toner production method according to (1), wherein the dispersion slurry comprises a surfactant.

(3) The toner production method according to (2), wherein the surfactant is one of a monovalent anionic surfactant and a divalent anionic surfactant.

(4) The toner production method according to any one of (1) to (3), wherein the releasing agent is one of a paraffin wax and a polyethylene wax.

(5) The toner production method according to any one of (1) to (4), wherein the binder resin comprises two or more different binder resins, and comprises a modified polyester resin comprising urethane or/and urea groups.

(6) The toner production method according to (5), wherein the polyester resin comprises a modified polyester resin component extended in chain length or/and crosslinked by a reaction of an amine and a modified polyester resin having an isocyanate group at a terminal thereof.

(7) A toner produced the toner production method according to any one of (1) to (6), wherein the peak intensity ratio R of a peak derived from the polyester skeleton (bisphenol derivative) to the peak derived from the releasing agent (ethylene chain) as measured with ATR-IR method satisfies the relation $0.03<R<0.1$, and wherein the endothermic amount H of the releasing agent in the toner as measured with the DSC method satisfies the relation 3 mJ/mg<H<7 mJ/mg.

(8) The toner according to (7), wherein the toner satisfies the relation $1 \geq H2/H1 \geq 0.9$, where H1 is an endothermic amount of the releasing agent contained in the toner as measured by the DSC method, and H2 is an endothermic amount of the releasing agent contained in the toner as measured by the DSC method, the toner used for measurement of H2 being prepared by dispersing the toner in a 10% by mass aqueous solution of sodium laurylsulfate to a toner dispersion concentration of 10% by mass to prepare a dispersion liquid by maintaining the dispersion liquid at a temperature higher than the melting point of the releasing agent by 10° C. or more for 10 hours followed by sufficient washing and drying.

(9) A toner container including the toner according to one of (7) and (8).

(10) A developer including the toner according to one of (7) and (8).

(11) An image forming apparatus using the developer according to (10).

(12) The image forming apparatus according to (11), wherein a roller is used as a fixing member.

(13) The image forming apparatus according to one of (11) and (12), wherein the fixing member is not coated with oil.

(14) A process cartridge including a photoconductor and at least one unit selected from a charging unit configured to charge the photoconductor, a developing unit, and a cleaning unit, wherein the process cartridge is detachably mounted to a main body of the image forming apparatus according to any one of (11) to (13).

<Toner Shape>

The shape of a toner (also referred to as a toner particle) is preferably closer to a spherical shape. When a toner is spherical, the transferability is improved, problems involving image dust and the like are hardly caused, and hence advantages of image quality improvement such as image reproducibility are provided. The circularity of toner is preferably 0.94 or more, more preferably 0.96 or more and furthermore preferably 0.97 or more.

<Binder Resin>

A resin included in the toner is preferably polyester resin from the viewpoint of the fixability and the heat-resistance/storage stability. In this connection, vinyl copolymer resin may be added in a small amount because vinyl copolymer resin is readily compatible with designs of the resin properties such as thermal properties and polarity and allows copolymerization of a polymerizable monomer having a particular functional group.

<Polyester Resin>

Examples of the polyester resins used in the present invention include polycondensates made from polyols (1) and polycarboxylic acids (2), and any such polycondensate may be used singly or as a mixture of several types of such polyester resins.

(Polyols)

Examples of the polyol (1) include: alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexane dimethanol and hydrogenated bisphenol A; bisphenols such as bisphenol A, bisphenol F and bisphenol S; 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (alias tetrafluorobisphenol A) and 2,2-bis(3-hydroxyphenyl)-1,1,1,3,3,3-hexafluoropropane; bis(4-hydroxyphenyl)ethers such as bis(3-fluoro-4-hydroxyphenyl)ether; alkylene oxide adducts of the above-listed alicyclic diols wherein examples of the alkylene oxide include ethylene oxide, propylene oxide and butylene oxide; and alkylene oxide adducts of the above-listed bisphenols wherein examples of the alkylene oxide include ethylene oxide, propylene oxide and butylene oxide.

Preferred among these are the alkylene glycols having 2 to 12 carbon atoms and the alkylene oxide adducts of the bisphenols; particularly preferred are the alkylene oxide adducts of bisphenols, and combinations of such adducts with alkylene glycols having 2 to 12 carbon atoms.

Further, examples of the polyol (1) include: trihydric to octahydric or higher polyhydric aliphatic alcohols such as glycerin, trimethylolethane, trimethylolpropane, pentaerythritol and sorbitol; trihydric or higher phenols such as trisphenol PA, phenol novolac and cresol novolac; and alkylene oxide adducts of the above-listed trihydric or higher polyphenols.

It is to be noted that the above-listed polyols can be used each alone or in combinations of two or more thereof, and the polyol (1) is not limited to the above-listed examples.

(Polycarboxylic Acid)

Examples of the polycarboxylic acids (2) include: alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl) hexafluoropropane, 2,2-bis(3-carboxyphenyl)hexafluoropropane, 2,2'-bis(trifluoromethyl)-4,4'-biphenyl dicarboxylic acid, 3,3'-bis(trifluoromethyl)-4,4'-biphenyl dicarboxylic acid, 2,2'-bis(trifluoromethyl)-3,3'-biphenyl dicarboxylic acid and hexafluoroisopropylidene diphthalic anhydride.

Preferred among these are the alkenylene dicarboxylic acids having 4 to 20 carbon atoms and the aromatic dicarboxylic acids having 8 to 20 carbon atoms. Further, as for the trihydric or higher carboxylic acids, the aromatic polycarboxylic acids having 9 to 20 carbon atoms such as trimellitic acid and pyromellitic acid, or the acid anhydrides or the lower alkyl esters, such as methyl esters, ethyl esters and isopropyl esters, of the above-described aromatic polycarboxylic acids may be used to be reacted with the polyol (1). It is to be noted that the above-listed polycarboxylic acids may be used each alone or in combinations of two or more thereof, and the polycarboxylic acid is not limited to the above-listed examples.

(Ratio of Polyol to Polycarboxylic Acid)

The ratio of the polyol (1) to the polycarboxylic acid (2) is, in terms of the equivalent ratio [OH]/[COOH] of the hydroxy group [OH] to the carboxyl group [COOH], usually 2/1 to 1/1, preferably 1.5/1 to 1/1, and more preferably 1.3/1 to 1.02/1.

(Molecular Weight of Polyester Resin)

The peak molecular weight is usually 1,000 to 30,000, preferably 1,500 to 10,000, and more preferably 2,000 to 8,000. When the peak molecular weight is less than 1,000, the heat-resistance/storage stability is degraded, and when the peak molecular weight exceeds 30,000, the low temperature fixability is degraded.

<Modified Polyester Resin>

In order to regulate the viscoelasticity for the purpose of prevention of offset and the like, the core-portion binder resin used in the present invention may include a modified polyester resin including urethane or/and urea groups. The content ratio of the modified polyester resin including urethane or/and urea groups, in the above-mentioned binder resin is preferably 20% by mass or less, more preferably 15% by mass or less and furthermore preferably 10% by mass or less. When the content ratio is larger than 20% by mass, the low temperature fixability is degraded. The modified polyester resin including urethane or/and urea groups may be directly mixed with the binder resin. However, from the viewpoint of the productivity, more preferably, a relatively low molecular weight modified polyester resin (herein after referred to as prepolymer as the case may be) having isocyanate groups at the terminals thereof and an amine to react with this resin are mixed in the binder resin, and undergo chain extension reaction or/and crosslinking reaction, during or after granulation, to yield the modified polyester resin including urethane or/and urea groups. In this way, a relatively high molecular weight modified polyester resin to regulate the viscoelasticity can be easily included in the core portion.

(Prepolymer)

Examples of the isocyanate group-containing prepolymers include a prepolymer obtained by further reacting a polycondensate between the polyol (1) and the polycarboxylic acid (2) with the polyisocyanate (3), the polycondensate being a polyester having active hydrogen groups. Examples of the active hydrogen groups possessed by the above-mentioned polyester include hydroxy groups (an alcoholic hydroxy group and a phenolic hydroxy group), an amino group, a carboxyl group and a mercapto group, and preferred among these is the alcoholic hydroxy group.

(Polyisocyanate)

Examples of the polyisocyanates (3) include: aliphatic polyisocyanates such as tetramethylene diisocyanate, hexamethylene diisocyanate and 2,6-diisocyanatomethyl caproate; alicyclic polyisocyanates such as isophorone diisocyanate and cyclohexylmethane diisocyanate; aromatic diisocyanates such as tolylene diisocynate and diphenylmethane diisocyanate; aromaliphatic diisocyanates such as $\alpha,\alpha,\alpha',\alpha'$-tetramethylxylylene diisocyanate; isocyanurates; the above-listed polyisocyanates blocked with phenol derivatives, oxime, caprolactam or the like; and combinations of two or more of these.

(Ratio of Isocyanate Group to Hydroxy Group)

The ratio of the polyisocyanate (3) is, in terms of the equivalent ratio [NCO]/[OH] of the isocyanate group [NCO] to the hydroxy group [OH] of the hydroxy group-containing polyester, usually 5/1 to 1/1, preferably 4/1 to 1.2/1, and more preferably 2.5/1 to 1.5/1. When the ratio [NCO]/[OH] exceeds 5, the low temperature fixability is degraded. When the molar ratio of [NCO] is less than 1, the urea content in the modified polyester is decreased to degrade the anti-offset property. The amount of the polyisocyanate (3) constituent in the prepolymer (A) having isocyanate groups at the terminal thereof is usually 0.5% by mass to 40% by mass, preferably 1% by mass to 30% by mass and more preferably 2% by mass to 20% by mass; when the content concerned is less than 0.5% by mass, the anti-offset property is degraded, and when the amount concerned exceeds 40% by mass, the low temperature fixability is degraded.

(Number of the Isocyanate Groups in the Prepolymer)

The number of the isocyanate groups contained in one molecule of the isocyanate group-containing prepolymer (A) is usually 1 or more, preferably 1.5 to 3 on average, and more preferably 1.8 to 2.5 on average. When the number concerned is less than 1 per one molecule, the molecular weight of the modified polyester after the chain extension and/or crosslinking is decreased to degrade the anti-offset property.

(Chain Extension and/or Crosslinking Agent)

In the present invention, an amine can be used as the chain extension and/or crosslinking agent. Examples of the amine (B) include a diamine (B1), a trivalent or higher polyamine (B2), an aminoalcohol (B3), an aminomercaptan (B4), an amino acid (B5), and the compounds (B6) obtained by blocking the amino groups in B1 to B5.

Examples of the diamines (B1) include the following:

aromatic diamines such as phenylenediamine, diethyltoluenediamine, 4,4'-diaminodiphenylmethane, tetrafluoro-p-xylylenediamine and tetrafluoro-p-phenylenediamine;

alicyclic diamines such as 4,4'-diamino-3,3'-dimethyldicyclohexylmethane, diaminecyclohexane and isophoronediamine; and aliphatic diamines such as ethylenediamine, tetramethylenediamine, hexamethylenediamine, dodecafluorohexylenediamine and tetracosafluorododecylenediamine.

Examples of the trivalent or higher polyamines (B2) include diethylenetriamine and triethylenetetramine. Examples of the aminoalcohol (B3) include ethanolamine and hydroxyethylaniline. Examples of the aminomercaptan (B4) include aminoethylmercaptan and aminopropylmercaptan. Examples of the amino acid (B5) include aminopropionic acid and aminocaproic acid.

Examples of the compounds (B6) obtained by blocking the amino groups of B1 to B5 include ketimine compounds and oxazoline compounds obtained from the B1 to B5 amines described above and ketones such as acetone, methyl ethyl ketone and methyl isobutyl ketone.

(Reaction Terminator)

Further, according to need, the molecular weight of the modified polyester after the reaction can be regulated by using a reaction terminator in the chain extension and/or the crosslinking reaction. Examples of the reaction terminator include monoamines such as diethylamine, dibutylamine, butylamine and lauryl amine and the compounds (ketimine compounds) obtained by blocking these amines.

(Ratio of Isocyanate Group to Amino Group)

The ratio of the amine (B) is, in terms of the equivalent ratio [NCO]/[NHx] of the isocyanate group [NCO] in the isocyanate group-containing prepolymer (A) to the amino group [NHx] in the amine (B), usually 1/2 to 2/1, preferably 1.5/1 to 1/1.5, and more preferably 1.2/1 to 1/1.2. When the ratio [NCO]/[NHx] is more than 2 or less than ½, the molecular weight of the urea-modified polyester (i) is decreased to degrade the anti-hot offset property.

<Colorant>

As the colorant of the present invention, all the heretofore known dyes and pigments can be used. Usable examples of such colorants include: carbon black, nigrosine dyes, black iron oxide, naphthol yellow S, hansa yellow (10G, 5G and G), cadmium yellow, yellow iron oxide, loess, chrome yellow, titanium yellow, polyazo yellow, oil yellow, hansa yellow (GR, A, RN and R), pigment yellow L, benzidine yellow (G and GR), permanent yellow (NCG), vulcan fast yellow (5G and R), tartrazine lake, quinoline yellow lake, anthrazane yellow BGL, isoindolinone yellow, red iron oxide, red lead, orange lead, cadmium red, cadmium mercury red, antimony orange, permanent red 4R, para red, fire red, p-chloro-o-nitroaniline red, lithol fast scarlet G, brilliant fast scarlet, brilliant carmine BS, permanent red (F2R, F4R, FRL, FRLL and F4RH), fast scarlet VD, vulcan fast rubine B, brilliant scarlet G, lithol rubine GX, permanent red F5R, brilliant carmine 6B, pigment scarlet 3B, bordeaux 5B, toluidine maroon, permanent bordeaux F2K, helio bordeaux BL, bordeaux 10B, bon maroon light, bon maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine, prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc oxide, lithopone and the mixtures of these colorants. The content of the colorant is usually 1% by mass to 15% by mass and preferably 3% by mass to 10% by mass in relation to the toner.

<Colorant in a Form of Master Batch>

The colorants used in the present invention can also be used as master batches in which the colorants are compounded with resins. Examples of the binder resins used in the preparation of the master batches and kneaded with the master batches include, in addition to the above-listed modified and unmodified polyester resins: polymers of styrene and the substitution products thereof such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer and styrene maleic acid ester copolymer; and polymethyl methacrylate, polybutyl methacrylate, polyvinyl chloride, polyvinyl acetate, polyethylene, polypropylene, polyester, epoxy resin, epoxypolyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin and paraffin wax. These binder resins can be used each alone or as mixtures thereof.

<Preparation of Master Batch>

The present master batch can be prepared by mixing and kneading a resin and a colorant for use in master batches by applying a high shearing force. In this preparation, an organic solvent can be used to increase the interaction between the colorant and the resin. In addition, because the wet cake of the colorant can be used as it is, namely, without being dried, a so-called flushing method is preferably used in which an aqueous paste of a colorant, including water, is mixed and kneaded with a resin and an organic solvent to transfer the colorant to the resin, and then the water and the organic solvent component are removed. For mixing and kneading, a high shear dispersion apparatus such as a three roll mill is preferably used.

<Releasing Agent>

Heretofore known releasing agents can be used as the releasing agent used in the present invention. Examples of such releasing agents include: polyolefin waxes such as polyethylene wax and polypropylene wax; long chain hydrocarbons such as paraffin wax and sasol wax; and carbonyl group-containing waxes. Examples of the carbonyl group-containing waxes include polyalkanoic acid esters such as carnauba wax, montan wax, trimethylolpropane tribehenate, pentaerythritol tetrabehenate, pentaerythritol diacetate dibehenate, glycerin tribehenate and 1,18-octadecanediol distearate; polyalkanol esters such as tristearyl trimellitate and distearyl maleate; polyalkanoic acid amides such as ethylenediamine dibehenylamide; polyalkylamides such as tristearylamide trimellitate; and dialkyl ketones such as distearyl ketone. Preferred among these carbonyl group-containing waxes are the polyalkanoic acid esters.

<External Additives>

(Inorganic Fine Particles)

Inorganic fine particles can be preferably used as the external additives to aid the fluidity, developability and chargeability of the colorant particles obtained in the present invention. The primary particle size of such an inorganic fine particle is preferably 5 nm to 2 μm, and particularly preferably 5 nm to 500 nm; the specific surface area of such an inorganic fine particle measured by the BET method is preferably 20 $m^2/g$ to 500 $m^2/g$. The used amount ratio of such an inorganic fine particle is preferably 0.01% by mass to 5% by mass of the toner, and particularly preferably 0.01% by mass to 2.0% by mass of the toner. Specific examples of the inorganic fine particles may include silica, alumina, titanium oxide, barium titanate, magnesium titanate, calcium titanate, strontium titanate, zinc oxide, tin oxide, quartz sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide and silicon nitride.

(Polymer Fine Particles)

Additionally, examples of the external additive include: polymer fine particles obtained by soap-free emulsion polymerization, suspension polymerization and dispersion polymerization, wherein the polymer materials involved are: polystyrene, methacrylate copolymers and acrylate copolymers; polycondensates such as silicone, benzoguanamine and nylon; and thermosetting resins.

(Surface Treatment of External Additive)

Such fluidizers are subjected to surface treatment to enhance the hydrophobicity, and thus can be prevented from the degradation of the fluidity and the chargeability even at high humidities. Preferable examples of the surface treatment agent include a silane coupling agent, a silylation agent, a fluorinated alkyl group-containing silane coupling agent, an organic titanate coupling agent, an aluminum coupling agent, a silicone oil and a modified silicone oil.

<Toner Production Method>

A toner is preferably produced by the following production method, although the method for producing a toner of the present invention is not limited to the following production method.

For the method for producing a toner of the present invention, preferably used is a method in which at least a polyester resin and a colorant are dissolved or dispersed in an organic solvent, and thereafter, the dissolved matter or the dispersed matter is dispersed in an aqueous medium for granulation. More specifically, the mentioned method is as follows.

<Granulation of Toner Particles>

(Organic Solvent)

The organic solvent dissolving or dispersing a polyester resin, a colorant and a releasing agent preferably has a boiling point lower than 100° C. and is volatile from the viewpoint that subsequent removal of the solvent is made easier. As such a solvent, for example, the following solvents can be used each alone or in combinations of two or more thereof: toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Particularly preferred among these are: esters such as methyl acetate and ethyl acetate; aromatic solvents such as toluene and xylene; and halogenated hydrocarbons such as methylene chloride, 1,2-dichloroethane, chloroform and carbon tetrachloride. The polyester resin, the colorant and the releasing agent may be dissolved or dispersed simultaneously; usually, these ingredients are dissolved or dispersed each alone, and the organic solvents used in this case may be different or the same; however, the organic solvents are preferably the same in consideration of the subsequent solvent handling.

(Dissolution or Dispersion of Polyester Resin)

In the dissolved solution or dispersion liquid of the polyester resin, the resin concentration is preferably approximately 40% by mass to 80% by mass. When the concentration is too high, dissolution or dispersion becomes difficult, and the viscosity becomes high to make handling difficult. On the other hand, when the concentration is too low, the amount of the produced toner becomes small. When the above-described modified polyester resin having isocyanate groups at the terminals thereof is mixed in the polyester resin, the modified polyester resin and the polyester resin may be mixed in the same dissolved solution or dispersion liquid, or may be separately dissolved or dispersed to prepare separate dissolved solutions or separate dispersion liquids; in consideration of the respective solubilities and the respective viscosities, it is preferable to prepare separate dissolved solutions or separate dispersion liquids.

(Dissolution or Dispersion of Colorant)

The colorant may be singly dissolved or dispersed, or may be mixed in the above-described dissolved solution or the dispersion liquid of the polyester resin. According to need, a dispersion aid or a polyester resin may be added, and the above-described mater batch may also be used.

(Dissolution or Dispersion of Releasing Agent)

When a wax is dissolved or dispersed as a releasing agent, if an organic solvent which does not dissolve the wax is used, the wax is used as a dispersion liquid, the dispersion liquid being prepared by a common method. In other words, the organic solvent and the wax are mixed together, and the wax may be dispersed with a dispersion machine such as a beads mill. On the other hand, the time required for completion of dispersion is made shorter sometimes in the following way: the organic solvent and the wax are mixed together, thereafter the mixture is heated once to the melting point of the wax, then the mixture is cooled under stirring, and then the wax is dispersed with a dispersing machine such as a beads mill. Alternatively, a plurality of types of waxes may be mixed to be used, and a dispersion aid and a polyester resin may be added.

(Aqueous Medium)

The aqueous medium to be used may be simply water, and a solvent miscible with water may also be used in combination. Examples of the miscible solvent include: alcohols such as methanol, isopropanol and ethylene glycol; dimethylformamide; tetrahydrofuran; cellosolves such as methyl cellosolve; and lower ketones such as acetone and methyl ethyl ketone. The used amount of the aqueous medium in relation to 100 parts by weight of a toner composition is usually 50 parts by weight to 2000 parts by weight, and preferably 100 parts by weight to 1000 parts by weight. When the used amount is less than 50 parts by weight, the dispersion condition of the toner composition is poor, and the toner particles of a predetermined particle size cannot be obtained. On the other hand, the used amount exceeding 2000 parts by weight is uneconomic.

(Inorganic Dispersant and Organic Resin Fine Particles)

When the dissolved matter or the dispersed matter of the toner composition is dispersed in the above-described aqueous medium, by beforehand dispersing an inorganic dispersant or organic resin fine particles in the aqueous medium, preferably the particle size distribution becomes sharp and the dispersion is made stable. As the inorganic dispersant, tricalcium phosphate, calcium carbonate, titanium oxide, colloidal silica, hydroxyapatite and the like are used. As the resin to form organic resin fine particles, any resin can be used as long as it is capable of forming an aqueous dispersion, and such a resin may be a thermoplastic resin or a thermosetting resin. Examples of such a resin include vinyl resin, polyurethane resin, epoxy resin, polyester resin, polyamide resin, polyimide resin silicon resin, phenolic resin, melamine resin, urea resin, aniline resin, ionomer resin and polycarbonate resin. These resins may be used in combinations of two or more thereof. From the viewpoint that aqueous dispersions of fine particulate resin particles are readily obtained, preferred among these are vinyl resin, polyurethane resin, epoxy resin, polyester resin and combinations of these resins.

(Method for Dispersing Organic Resin Fine Particles in an Aqueous System)

The method for converting a resin into an aqueous dispersion liquid of organic resin fine particles is not particularly limited; examples of such a method include the following (a) to (h).

(a) A method for directly preparing an aqueous dispersion liquid of resin fine particles from a monomer as a starting raw material, in the case of a vinyl resin, by using a polymerization reaction such as the suspension polymerization method, the emulsion polymerization method, the seed polymerization method or the dispersion polymerization method.

(b) A method for preparing an aqueous dispersion liquid of resin fine particles, in the case of a polyaddition or condensation resin such as polyester resin, polyurethane resin or epoxy resin, by dispersing a precursor (such as a monomer or an oligomer) or the solvent solution of the precursor in an aqueous medium in the presence of an appropriate dispersant, and by thereafter setting by heating or adding a setting agent.

(c) A method in which phase transition emulsification is carried out, in the case of a polyaddition or condensation resin such as polyester resin, polyurethane resin or epoxy resin, by dissolving an appropriate emulsifying agent and thereafter adding water in a precursor (such as a monomer or an oligomer) or the solvent solution of the precursor (the solvent solution is preferably a liquid, and may be liquefied by heating).

(d) A method in which a resin beforehand prepared by a polymerization reaction (the polymerization reaction mode may be any of addition polymerization, ring-opening polymerization, polyaddition, addition condensation, polycondensation and the like) is pulverized by using a pulverizing mill such as a mechanical rotation pulverizing mill or a jet pulverizing mill, the pulverized resin is then classified to yield resin fine particles, and thereafter the resin fine particles are dispersed in water in the presence of an appropriate dispersant.

(e) A method in which resin fine particles are obtained by spraying as a mist a resin solution prepared by dissolving in a solvent a resin beforehand prepared by a polymerization reaction (the polymerization reaction mode may be any of addition polymerization, ring-opening polymerization, polyaddition, addition condensation, polycondensation and the like), and thereafter, the resin fine particles are dispersed in water in the presence of an appropriate dispersant.

(f) A method in which resin fine particles are precipitated by adding a solvent a resin solution prepared by dissolving in a solvent a resin beforehand prepared by a polymerization reaction (the polymerization reaction mode may be any of addition polymerization, ring-opening polymerization, polyaddition, addition condensation, polycondensation and the like), or by cooling a resin solution beforehand prepared by dissolving a resin in a solvent by heating, and thereafter the resin fine particles are obtained by removing the solvent and then dispersed in water in the presence of an appropriate dispersant.

(g) A method in which a resin solution prepared by dissolving in a solvent a resin beforehand prepared by a polymerization reaction (the polymerization reaction mode may be any of addition polymerization, ring-opening polymerization, polyaddition, addition condensation, polycondensation and the like) is dispersed in an aqueous medium in the presence of an appropriate dispersant, and the solvent is removed from the dispersion liquid thus obtained by heating, pressure reduction or the like.

(h) A method in which phase transition emulsification is carried out by dissolving an appropriate emulsifying agent in a resin solution prepared by dissolving in a solvent a resin beforehand prepared by a polymerization reaction (the polymerization reaction mode may be any of addition polymerization, ring-opening polymerization, polyaddition, addition condensation, polycondensation and the like), and by thereafter adding water to the resin solution.

(Surfactant)

Additionally, for the purpose of emulsifying and dispersing the oil phase including the toner composition in an aqueous medium, a surfactant or the like can also be used according to need. Examples of the surfactant include: anionic surfactants such as alkylbenzenesulfonic acid salts, α-olefinsulfonic acid salts and phosphoric acid esters; amine salt cationic surfactants such as alkylamine salts, aminoalcohol fatty acid derivatives, polyamine fatty acid derivatives and imidazolines; quaternary ammonium salt cationic surfactants such as alkyltrimethylammonium salts, dialkyldimethylammonium salts, alkyldimethylbenzylammonium salts, pyridinium salts, alkylisoquinolinium slats and benzethonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine.

Additionally, by using surfactants having fluoroalkyl groups, the advantageous effects of the surfactants can be achieved with very small amounts. Examples of the preferably used anionic surfactants each having a fluoroalkyl group include: fluoroalkyl carboxylic acids having 2 to 10 carbon atoms and the metal salts thereof, disodium perfluorooctanesulfonyl glutamate, sodium 3-[ω-fluoroalkyl(C6-C11)oxy]-1-alkyl(C3-C4)sulfonate, sodium 3-[ω-fluoroalkanoyl(C6-C8)]-N-ethylamino]-1-propanesulfonate, fluoroalkyl(C11-C20) carboxylic acids and the metal salts thereof, perfluoroalkylcarboxylic acids (C7-C13) and the metal salts thereof, perfluoroalkyl(C4-C12)sulfonic acids and the metal salts thereof, perfluorooctanesulfonic acid diethanolamide, N-propyl-N-(2-hydroxyethyl)perfluorooctanesulfonamide, perfluoroalkyl(C6-C10)sulfonamide propyltrimethylammonium salts, perfluoroalkyl(C6-C10)-N-ethylsulfonyl glycine salts and monoperfluoroalkyl(C6-C16)ethyl phosphates. Additionally, examples of the cationic surfactants include aliphatic primary, secondary and tertiary amine acids each having a fluoroalkyl group; aliphatic quaternary ammonium salts such as perfluoroalkyl(C6-C10)sulfonamidepropyltrimethyl ammonium salts; benzalkonium salts; benzetonium chlorides; pyridinium salts; and imidazolinium salts.

(Protective Colloid)

Additionally, the dispersion droplets may be stabilized by using polymer protective colloids. Examples of the usable polymers include homopolymers and copolymers of: acids such as acrylic acid, methacrylic acid, α-cyanoacrylic acid, α-cyanomethacrylic acid, itaconic acid, crotonic acid, fumaric acid, maleic acid and maleic anhydride; hydroxy group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide and N-methylolmethacrylamide; vinyl alcohol and ethers derived from vinyl alcohol such as vinyl methyl ether, vinyl ethyl ether and vinyl propyl ether; esters between vinyl alcohol and carboxyl group-containing compounds such as vinyl acetate, vinyl propionate and vinyl butyrate; acrylamide, methacrylamide, and diacetone acrylamide, and methylol compounds of these amides; acid chlorides such as acrylic acid chloride and methacrylic acid chloride; nitrogen-containing or nitrogen-containing heterocycle-containing compounds such as vinylpyridine, vinylpyrrolidone, vinylimidazole and ethyleneimine. Additionally, examples of the usable polymers include polyoxyethylene polymers such as polyoxyethylene, polyoxypropylene, polyoxyethylenealkylamine, polyoxypropylenealkylamine, polyoxyethylenealkylamide, polyoxypropylenealkylamide, polyoxyethylenenonylphenylether, polyoxyethylenelaurylphenylether, polyoxyethylenestearylphenylester, polyoxyethylenenonylphenylester; and celluloses such as methyl cellulose, hydroxyethyl cellulose and hydroxypropyl cellulose. It is to be noted that when substances such as calcium phosphate salt soluble in acid and alkali are used as a dispersion stabilizer, the calcium phosphate salt is removed from the fine particles by dissolving the calcium phosphate salt with an acid such as hydrochloric acid, and by thereafter washing the fine particles with water. Alternatively, the calcium phosphate salt can also be removed by operations such as decomposition by an enzyme. When a dispersant is used, the dispersant may be allowed to remain on the surface of the toner particles; however, the dispersant is preferably removed by washing from the viewpoint of the charging of the toner.

(Method for Dispersion)

The method for dispersion is not particularly limited, and can apply heretofore known equipment such as a low-speed-shear disperser, a high-speed-shear disperser, a friction disperser, a high-pressure-jet disperser, a ultrasonic disperser. A high-speed-shear disperser is preferable for the purpose of making the particle size of a dispersion be 2 μm to 20 μm. When a high-speed-shear disperser is used, the number of rotation is not particularly limited, and is usually 1000 rpm to 30000 rpm and preferably 5000 rpm to 20000 rpm. The temperature at the time of dispersion is usually 0° C. to 150° C. (under increased pressure) and preferably 20° C. to 80° C.

(Removal of Solvent)

For the purpose of removing the organic solvent from the obtained emulsified dispersion, heretofore known methods can be used. For example, there can be adopted a method in which the organic solvent in the droplets is perfectly evaporated to be removed by gradually increasing the temperature of the whole dispersion system under normal or reduced pressure.

(Extension or/and Crosslinking Reaction)

When, for the purpose of introducing the modified polyester resin having urethane or/and urea groups, the modified polyester resin having isocyanate groups at the terminals thereof and an amine capable of reacting with the latter modified polyester resin are added, the amine may be mixed in an oil phase before a toner composition is dispersed in an aqueous medium, or may be added in the aqueous medium. The time required for the above-described reaction is selected according to the reactivity between the isocyanate group structure of the polyester prepolymer and the added amine, and is usually 1 minute to 40 hours and preferably 1 hour to 24 hours. The reaction temperature is usually 0° C. to 150° C. and preferably 20° C. to 98° C.

<Washing and Drying Steps>

The steps of washing and drying the toner particles dispersed in an aqueous medium use heretofore known techniques.

Specifically, the impurities, the surfactant and the like are removed by repeating several times a step in which solid-liquid separation is carried out by using a centrifugal separator, a filter press or the like, thereafter the toner cake thus obtained is redispersed in ion-exchanged water set at room temperature to approximately 40° C., the pH is regulated, according to need, with an acid and an alkali, and thereafter solid-liquid separation is carried out again; thereafter, drying is carried out by using a pneumatic conveying dryer, a circulation dryer, a reduced pressure dryer, a vibration flow dryer or the like to yield a toner powder. In this case, a fine particle component of the toner may be removed by centrifugal separation or the like, or by using a heretofore known classification apparatus after drying, according to need, a desired particle size distribution may be attained.

<Heat Treatment>

In the present invention, it is essential to heat the toner particles dispersed in an aqueous medium to a temperature equal to or higher than the melting point of the contained releasing agent before the toner particles dispersed in the aqueous medium is washed. This heat treatment melts the releasing agent exposed to the toner surface so as to separate the releasing agent into the aqueous medium. At this time, the separation of the molten releasing agent requires a sufficient amount of surfactant for dispersing the releasing agent in the aqueous medium. As the surfactant, the surfactant used in granulation of the toner may be used as it is, or may be added anew. In either case, it is important to sufficiently wash out the releasing agent in the step of washing subsequent to the heat treatment. It suffices that the heating temperature be equal to or higher than the melting point of the releasing agent; however, care should be exercised in setting the heating temperature, because when the heating temperature is too high, the toner particles undergo mutual aggregation as the case may be. Additionally, when the removal of the solvent is insufficient, there is a fear of mutual aggregation of the toner particles. Further, also when the concentration of the surfactant is too thin, there is a fear of mutual aggregation of the toner particles.

<External Additive Treatment>

The obtained toner powder after drying is mixed with foreign particles such as the above-described charge regulating fine particles and fluidizing fine particles, and the foreign particles are fixed or fused onto the powder surface by applying mechanical impact to the mixed powder, so that the detachment of the foreign particles from the surface of the obtained composite particles can be prevented. Specific examples of the technique to apply mechanical impact include: a method in which impact is applied to the mixture by using blades rotating at high speed; and a method in which the mixture is placed in a high-velocity gas stream to accelerate the particles to collide with each other or to accelerate the prepared composite particles to collide with an appropriate collision plate. Examples of the apparatus for this purpose include Ongmill (manufactured by Hosokawa Micron Corp.), I-type mill (manufactured by Nippon Neumatic Co., Ltd.) modified so as to reduce the pulverizing air pressure, Hybridization System (manufactured by Nara Machinery Co., Ltd.), Cryptron System (manufactured by Kawasaki Heavy Industries, Ltd.) and an automatic mortar.

<Process Cartridge>

The developer of the present invention can be used in, for example, an image forming apparatus, as shown in FIG. 1, equipped with a process cartridge.

In the present invention, a process cartridge is formed by integrating, into one piece, two or more of the above-described constituent elements such as the photoconductor, the charging unit, the developing unit and the cleaning unit, and the process cartridge is configured so as to be attachable to and detachable from the body of an image forming apparatus such as a copying machine or a printer.

The process cartridge shown in FIG. 1 includes a photoconductor, a charging unit, a developing unit and a cleaning unit. The operation of the process cartridge is described as follows. The photoconductor is driven to rotate at a predetermined circumferential speed. In the course of the rotation, the outer surface of the photoconductor is uniformly charged by the charging unit so as to have a predetermined positive or negative electrical potential. Then, the photoconductor receives image exposure light from an image exposure unit such as a slit exposure unit or a laser beam scanning exposure unit, and thus electrostatic latent images are sequentially formed on the outer surface of the photoconductor. The formed electrostatic latent images are then toner-developed by the developing unit, and the developed toner images are sequentially transferred by a transfer unit on a transfer medium fed synchronously with the rotation of the photoconductor between the photoconductor and the transfer unit from a medium feeding unit. The transfer medium that has undergone the image transfer is separated from the surface of the photoconductor, then introduced into an image fixing apparatus to undergo image fixing, and printed out outside the apparatus as a copied matter (copy) or a printed matter (print). After the image transfer, the surface of the photoconductor undergoes the removal of the remaining untransferred toner by the cleaning unit to have the surface cleaned, is again electrically neutralized and is thereafter used repeatedly for image formation.

EXAMPLES

Hereinafter, Examples according to the present invention are described.

Here are first described the measurement methods and the evaluation methods of the toner. It is to be noted that hereinafter, the evaluation was carried out as a one-component developer, but the toner of the present invention can also be used as a two-component developer by using a suitable external additive treatment and a suitable carrier.

<Measurement Methods>

(Particle Diameter)

The measurement method of the particle size distribution of the toner particles is described.

Examples of the measurement apparatus of the particle size distribution of the toner particles measured by the Coulter counter method include Coulter Counter TA-II and Coulter Multisizer II (both manufactured by Coulter Corp.). The measurement method is described below.

First, in 100 ml to 150 ml of an electrolytic aqueous solution, 0.1 ml to 5 ml of a surfactant (preferably alkylbenzenesulfonic acid salt) is added as a dispersant. Here, the electrolytic solution is an approximately 1% by mass aqueous solution of NaCl prepared by using first grade sodium chloride; as such a solution, for example, ISOTON-II (manufactured by Coulter Corp.) can be used. Here, a sample to be measured is added in an amount of 2 mg to 20 mg in terms of the solid content. The electrolytic solution with the sample suspended therein is subjected to a dispersion treatment with an ultrasonic disperser approximately for 1 minute to 3 minutes. With the above-described measurement apparatus, by using a 100-μm aperture as the aperture, the volume and the particle number of the toner particles or the toner are measured to derive the volume distribution and the number distribution. From the thus obtained distributions, the volume average particle size (Dv) and the number average particle size (Dn) of the toner can be derived.

As the channels, for example, the following 13 channels can be used: 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; 32.00 μm to less than 40.30 μm; and the particles having a particle size of 2.00 μm or more and less than 40.30 μm can be the objects of the measurement.

(Average Circularity)

Appropriate as a shape measurement method is an optical detection zone technique in which a particle-containing suspension liquid is made pass through the detection zone of an imaging section on a plate, the particle image is optically detected with a CCD camera, and the particle image thus obtained is analyzed. The average circularity is obtained by dividing the circumference length of a corresponding circle having the same area as the projection area, obtained by this technique, of the actual particles by the circumference length of the actual particles.

This value is a value measured as the average circularity by using a flow-type particle image analyzer FPIA-2000. Specifically, the measurement method is as follows. In 100 ml to 150 ml of water, in a vessel, from which the solid impurity content has been removed beforehand, a surfactant, preferably 0.1 ml to 0.5 ml of an alkylbenzenesulfonic acid salt is added as a dispersant, and further, approximately 0.1 g to 0.5 g of a measurement sample is added. The suspension liquid with the sample dispersed therein is subjected to a dispersion treatment with an ultrasonic disperser approximately for 1 minute to 3 minutes, and the dispersion liquid concentration is set to be 3000 particles/μl to 10000 particles/μl; thereafter, with the above-described apparatus, the shape and the distribution of the toner are measured, and thus the average circularity is obtained.

(Molecular Weight)

The molecular weights of the polyester resins and the vinyl copolymer resins used were measured by usual GPC (gel permeation chromatography) under the following conditions.

Instrument: HLC-8220 GPC (manufactured by Tosoh Corp.)

Columns: TSK gel Super HZM-M×3

Temperature: 40° C.

Solvent: THF (tetrahydrofuran)

Flow rate: 0.35 ml/min

Sample: Sample having a concentration of 0.05% by mass to 0.6% by mass is injected in an amount of 0.01 ml.

From the molecular weight distribution of the toner resin measured under the above-described conditions, the weight average molecular weight Mw was calculated by using a molecular weight calibration curve prepared on the basis of the monodisperse polystyrene standard samples. The following ten monodisperse polystyrene standard samples were used: 5.8×100, 1.085×10000, 5.95×10000, 3.2×100000, 2.56×1000000, 2.93×1000, 2.85×10000, 1.48×100000, 8.417×100000, 7.5×1000000.

(Glass Transition Point)

The glass transition points of the polyester resins and the vinyl copolymer resins used can be measured by using, for example, a differential scanning calorimeter (for example, DSC-6220R: Seiko Instruments Inc.) as follows. First, a sample is heated from room temperature to 150° C. at a temperature increase rate of 10° C./min, thereafter the sample is allowed to stand at 150° C. for 10 minutes, then the sample is cooled down to room temperature and allowed to stand at room temperature for 10 minutes. The sample is again heated to 150° C. at a temperature increase rate of 10° C./min to obtain a DSC curve; the glass transition point can be obtained from the midpoint, on the DSC curve, between the baseline in the region below the glass transition point and the baseline in the region above the glass transition point.

(Particle Size of Fine Particles)

The particle sizes of the vinyl copolymer resin fine particles and the like can be measured, as particles in a dispersion, by using a measurement apparatus such as LA-920 (Horiba Seisakusho Co., Ltd.) or UPA-EX150 (Nikkiso Co., Ltd.).

(Measurement of Infrared Absorption Spectra)

For each of the obtained toner bases, by using the ATR-IR method, the intensity ratio R of the peak intensity (I1) derived from the polyester (Pes) skeleton (bisphenol derivative) from the binder resin to the peak intensity (I2) derived from the releasing agent (ethylene chain) was measured.

In this case, the measurement of the infrared absorption spectrum of a developer was carried out as follows.

The FT-ATR-IR method was applied. In a mold of 4 cm in diameter, 3 g of a developer was placed, and the whole of the developer was press molded under a pressure of 6 MPa for 30 seconds into a sample. By using the sample, the surface thereof was measured. Additionally, the measurement was carried out by using air as the background, and by applying 16 runs of scanning over a range from 4000 $cm^{-1}$ to 450 $cm^{-1}$.

Then, the peak absorbance values I1 and I2 were determined as follows.

First, I1 was determined as the peak height around 828 $cm^{-1}$ from the baseline connecting the both valleys (at around 743 $cm^{-1}$ and around 890 $cm^{-1}$) on both sides of the peak at around 828 $cm^{-1}$, and similarly, I2 was determined as the peak height around 2850 $cm^{-1}$ from the baseline connecting the both valleys (at around 2834 $cm^{-1}$ and around 2862 $cm^{-1}$) on both sides of the peak at around 2850 $cm^{-1}$.

The apparatus used for the measurement is as follows.

Instrument: Spectrum One FT-IR Spectrometer manufactured by PerkinElmer Inc.

Microscope for FT-ATR-IR measurement: AutoIMAGE FT-IR Microscope manufactured by PerkinElmer Inc.

Internal reflection element (IRE) for FT-ATR-IR measurement: Ge (germanium)

(Endothermic Amount)

For each of the obtained base toners, the endothermic amount H1 (mJ/mg) of the releasing agent contained in the toner base was measured by the DSC method. After the toner base was obtained again by maintaining a dispersion liquid including the toner base dispersed in a 10% by mass aqueous solution of sodium laurylsulfate so as for the toner dispersion concentration to be 10% by mass, at a temperature higher than the melting point of the included releasing agent by 10° C. or more for 10 hours, and thereafter by sufficiently washing and drying the toner base, the endothermic amount H2 (mJ/mg) of the releasing agent included in the toner base was measured by the DSC method. The endothermic amount was analyzed by using a common method in which the endothermic amount was obtained by using as the baseline the line connecting the both ends of a peak. When two or more endothermic peaks of a releasing agent were present to be separated away from each other, only the highest temperature peak of such peaks was analyzed. In general, the temperature of the highest temperature peak is defined as the melting point of the releasing agent.

<Evaluation Methods>

(Evaluation of Chargeability)

With a toner (developer) subjected to the external additive treatment, by using a printer, IPSIO CX2500 manufactured by Ricoh Co., Ltd., a predetermined print pattern having a B/W ratio of 6% was continuously printed under N/N environmental conditions (23° C., 45%). After the printing of 50 sheets under N/N environmental conditions, the toner on the developing roller being engaged in printing a blank pattern was sucked, and the charge amount of the toner was measured with an electrometer to evaluate the charge amount.

A: The charge amount is 30 μC/g or more.

B: The charge amount falls within a range from 25 μC/g to 30 μC/g.

C: The charge amount falls within a range from 20 μC/g to 25 μC/g.

D: The charge amount is 20 μC/g or less.

(Evaluation of Anti-Stress Property)

With a toner (developer) subjected to the external additive treatment, by using a printer, IPSIO CX2500 manufactured by Ricoh Co., Ltd., a predetermined print pattern having a B/W ratio of 6% was continuously printed under N/N environmental conditions (23° C., 45%). After the continuous printing of 2000 sheets (after endurance) under N/N environmental conditions, the toner on the developing roller being engaged in printing a blank pattern was sucked, and the charge amount of the toner was measured with an electrometer, and the charge amount difference between after printing of 50 sheets and after printing of 2000 sheets was evaluated.

[Evaluation Criteria]

A: The absolute value of the charge amount difference is 5 μC/g or less.

B: The absolute value of the charge amount difference falls within a range from 5 μC/g to 10 μC/g.

C: The absolute value of the charge amount difference falls within a range from 10 μC/g to 15 μC/g.

D: The absolute value of the charge amount difference is 15 μC/g or more.

(Evaluation of Image Staining)

With a toner (developer) subjected to the external additive treatment, by using a printer, IPSIO CX2500 manufactured by Ricoh Co., Ltd., a predetermined print pattern having a B/W ratio of 6% was continuously printed under N/N environmental conditions (23° C., 45%). After the continuous printing of 2000 sheets (after endurance) under N/N environmental conditions, a test pattern was printed to evaluate the image staining in terms of the presence/absence of toner streaks and black spots in the blank portions and the presence/absence of blank streaks and blank spots in the solid image portions.

[Evaluation Criteria]

A: No image staining is found.

B: One or two stained image portions are found.

C: Three to five stained image portions are found.

D: Six or more stained image portions are found.

(Evaluation of Transferability)

With a toner (developer) subjected to the external additive treatment, by using a printer, IPSIO CX2500 manufactured by Ricoh Co., Ltd., a 1-cm wide transverse black band was printed, the operation was forced to halt in such a way that the developed image on the photoconductor remained, and the amount of the toner attached to the photoconductor was measured. After resetting, the same printing was made again, the operation was forced to halt in such a way that the toner image was transferred from the photoconductor onto the transfer medium, and the amount of the toner attached to the transfer medium was measured. The ratio of the amount of the toner transferred onto the transfer medium to the amount of the toner attached to the photoconductor was measured for evaluation.

[Evaluation Criteria]

A: Approximately 100% by mass.

B: 98% by mass or more.

C: 95% by mass or more.

D: Less than 95% by mass.

(Evaluation of Fixability and Paper Separatability (Fixing OW))

With a toner (developer) subjected to the external additive treatment, by using a printer, IPSIO CX2500 manufactured by Ricoh Co., Ltd., a 36-mm wide solid band image (attached amount: 11 g/m$^2$) was printed on the leading end portion, within 3 mm from the edge, of an A4 size longitudinally fed paper, and thus an unfixed image was prepared. This unfixed images were fixed by using the below-described fixing apparatus at fixing temperatures varied between 115° C. and 175° C. in steps of 10° C. to determine the paper-separable/anti-offset temperature range—a range within which separation of paper from the heating roller is smoothly effect and no offset occurs. The used paper and the paper feeding direction were such that short grain paper of 45 g/m$^2$, unfavorable to the separability, was used and longitudinal paper feeding was adopted. The circumferential speed of the fixing apparatus was set at 120 mm/sec.

Figure 2:
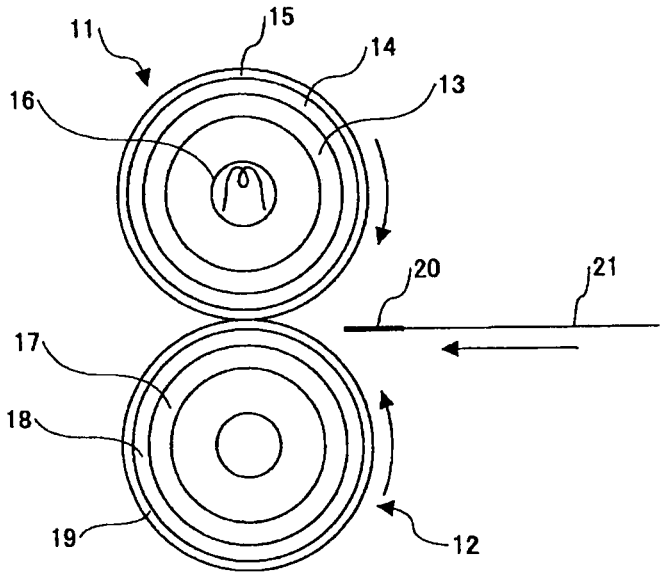
FIG. 2 is a schematic view illustrating an example of a configuration of a fixing apparatus used in the present invention.

As shown in FIG. 2, the fixing apparatus is of a soft roller type configured with a fluorochemical surface layer material. Specifically, the heating roller 11 is 40 mm in outer diameter, and has, on an aluminum cored bar 13, a 1.5-mm thick elastic layer 14 composed of a silicone rubber and a surface layer 15 formed of PFA (tetrafluoroethylene-perfluoroalkyl vinyl ether copolymer). The heating roller 11 is equipped with a heater 16 inside the aluminum cored bar. The pressure roller 12 is 40 mm in outer diameter, and has, on the aluminum cored bar 17, a 1.5-mm thick elastic layer 18 composed of a silicone rubber and a PFA surface layer 19. It is to be noted that a sheet of paper 21 with an unfixed image 20 printed thereon is fed as shown in the drawing.

The evaluation criteria are as follows.

A: Paper-separable/anti-offset temperature covered the whole range from 115° C. to 175° C., and the durability of the fixed image was sufficient.

B: Paper-separable/anti-offset temperature covered the whole range from 115° C. to 175° C., but fixed image in the low temperature range was readily peeled and damaged by scratching and rubbing.

C: Paper-separable/anti-offset temperature range was 30° C. or higher and lower than 50° C.

D: Paper-separable/anti-offset temperature was lower than 30° C.

(Heat-Resistance/Storage Stability)

The toner was stored at 50° C. for 8 hours, and thereafter sieved with a 42-mesh sieve for 2 minutes. The residual ratio on the metal gauze was used as an index for the heat-resistance/storage stability. The heat-resistance/storage stability was evaluated on the following four grades.

D: The residual ratio was 30% by mass or more.

C: The residual ratio was 20% by mass to 30% by mass.

B: The residual ratio was 10% by mass to 20% by mass.

A: The residual ratio was less than 10% by mass.

The present invention was embodied as follows.

<Synthesis of Polyester>

(Polyester 1)

In a reaction vessel equipped with a condenser, a stirrer and a nitrogen introducing tube, 553 parts of 2-mol ethylene oxide adduct of bisphenol A, 196 parts of 2-mol propylene oxide adduct of bisphenol A, 220 parts of terephthalic acid, 45 parts of adipic acid and 2 parts of dibutyltin oxide were placed; the reaction mixture was allowed to react at normal pressure at 230° C. for 8 hours, and further allowed to react at reduced pressures of 10 mmHg to 15 mmHg for 5 hours; thereafter, 26 parts of trimellitic anhydride was added in the reaction vessel, and the reaction mixture was allowed to react at normal pressure for 2 hours to yield a [polyester 1]. The [polyester 1] had a number average molecular weight of 2,200, a weight average molecular weight of 5,600, a Tg of 43° C., and an acid number of 24.

<Synthesis of Prepolymer>

In a reaction vessel equipped with a condenser, a stirrer and a nitrogen introducing tube, 366 parts of 1,2-propylene glycol, 566 parts of terephthalic acid, 44 parts of trimellitic anhydride and 6 parts of titanium tetrabutoxide were placed; the reaction mixture was allowed to react at normal pressure at 230° C. for 8 hours, and further allowed to react at reduced pressures of 10 mmHg to 15 mmHg for 5 hours to yield a [intermediate polyester 1]. The [intermediate polyester 1] had a number average molecular weight of 3,200, a weight average molecular weight of 12,000 and a Tg of 55° C.

Next, in a reaction vessel equipped with a condenser, a stirrer and a nitrogen introducing tube, 420 parts of the [intermediate polyester 1], 80 parts of isophorone diisocyanate and 500 parts of ethyl acetate were placed; the reaction mixture was allowed to react at 100° C. for 5 hours to yield a [prepolymer 1]. The percentage by mass of the isolated isocyanate in the [prepolymer 1] was found to be 1.34% by mass.

<Synthesis of Master Batch>

By using a Henschel mixer, 40 parts of carbon black (Regal 400R, manufactured by Cabot Inc.), 60 parts of a binder resin, namely, polyester resin (RS-801, manufactured by Sanyo Chemical Industries, Ltd., acid number: 10, Mw: 20,000, Tg: 64° C.) and 30 parts of water were mixed, and thus there was obtained a mixture in which water was impregnated into the pigment aggregates. The mixture was kneaded with two rollers set at a roller surface temperature of 130° C. for 45 minutes, and then pulverized with a pulverizer into a particle size of 1 mm diameter to yield a [master batch 1].

Example 1

Preparation of Dispersion Liquid (Oil Phase)

In a vessel equipped with a stirring rod and a thermometer, 96 parts of the [polyester 1], 32 parts of paraffin wax (melting point: 72° C.) and 383 parts of ethyl acetate were placed, and the reaction mixture thus obtained was increased in temperature under stirring to 80° C., maintained at 80° C. for 5 hours, and thereafter cooled down to 30° C. over a period of 1 hour. The mixture thus obtained was transferred to another vessel, and the mixture was dispersed by using a beads mill (Ultravisco mill, manufactured by Aimex Co., Ltd.) under the conditions that the liquid feeding rate was 1 kg/hr, the disk circumferential speed was 6 m/sec, 0.5-mm zirconia beads were loaded such that they make up 80% by volume of the interior or the mill, and the number of pass was three. In this way a [raw material dissolved liquid 1] was obtained. Then, 325 parts of the [raw material dissolved liquid 1] was added with 338 parts of a 70% by mass ethyl acetate solution of the [polyester 1] and 140 parts of the [master batch 1], and the mixture thus obtained was stirred with a three-one motor for 2 hours, to yield an [oil phase 1]. Ethyl acetate was added to the [oil phase 1] in such a way that the solid content concentration (measured at 130° C. in 30 minutes) of the [oil phase 1] was adjusted to 50% by mass.

<Preparation of Aqueous Phase>

A milky white liquid was obtained by mixing under stirring 834.5 parts of ion-exchanged water, 154 parts of a 50% by mass aqueous solution (Eleminol MON-7, manufactured by Sanyo Chemical Industries, Ltd.) of sodium dodecyl diphenyl ether disulfonate, 192.5 parts of a 1% by mass aqueous solution of carboxymethyl cellulose as a thickener and 102 parts of ethyl acetate. This milky white liquid is referred to as the [aqueous phase 1].

<Emulsification Step>

To the total amount of the above-described [oil phase 1], 115 parts of the [prepolymer 1] and 1.5 parts of isophorone diamine were added; the mixture thus obtained was mixed by using a TK homomixer (manufactured by Tokushukika Kogyo Co., Ltd.) at 5,000 rpm for 1 minute, then added with 835 parts of [aqueous phase 1], and mixed by using TK homomixer for 5 minutes while the number of rotations was being regulated to fall within a range from 8,000 rpm to 13,000 rpm, to yield an [emulsified slurry 1].

<Removal of Solvent>

In a vessel equipped with a stirrer and a thermometer, the [emulsified slurry 1] was placed, and subjected to removal of the solvent at 30° C. for 8 hours to yield a [dispersion slurry 1].

<Heat Treatment>

In a vessel equipped with a stirrer and a thermometer, the [dispersion slurry 1] was placed, heated under sufficient stirring to 80° C., namely, to a temperature higher by 8° C. than the melting point of the releasing agent, maintained at 80° C. for 1 hour, and then cooled down to room temperature.

<Washing→Drying>

After 1,000 parts of the [dispersion slurry 1] was subjected to reduced pressure filtration, processing was carried out in the following order.

(1) The filtered cake was added and mixed with 1,000 parts of ion-exchanged water by using a TK homomixer (at a number of rotation of 12,000 rpm for 10 minutes), and then filtered.

(2) The filtered cake of (1) was added with 1,000 parts of ion-exchanged water, the mixture thus obtained was applied with ultrasonic vibration and mixed by using a TK homomixer (at a number of rotation of 12,000 rpm for 30 minutes), and then filtered under reduced pressure. This operation was repeated so as for the electric conductivity of the reslurry solution to be 10 μS/cm or less.

(3) The reslurry solution of (2) was added with a 10% by mass hydrochloric acid solution so as for the pH of the reslurry solution of (2) to be 4, stirred as it is with a three-one motor for 30 minutes, and then filtered.

(4) The filtered cake of (3) was added and mixed with 1,000 parts of ion-exchanged water by using a TK homomixer (at a number of rotation of 12,000 rpm for 10 minutes), and then filtered. This operation was repeated so as for the electric conductivity of the reslurry solution to be 10 μS/cm or less, and thus a [filtered cake 1] was obtained.

The [filtered cake 1] was dried at 45° C. for 48 hours by using an air circulation dryer, and sieved with a sieve having a mesh opening of 75 μm to yield a [toner base 1]. The volume average particle size (Dv) was 5.3 μm, the number average particle size (Dn) was 4.8 μm, Dv/Dn was 1.10 and the average circularity was 0.975. Successively, 100 parts of this toner base was added and mixed with 0.5 part of hydrophobic silica having a primary particle size of approximately 30 nm and 0.5 part of hydrophobic silica having a primary particle size of approximately 10 nm by using a Henschel mixer to yield a [developer 1] of the present invention.

The peak intensity ratio R of the peak intensity derived from the Pes skeleton (bisphenol derivative) to the peak intensity derived from the releasing agent (ethylene chain), as measured ATR-IR method, was found to be 0.043.

The endothermic amounts H1 and H2 of the releasing agent included in the toner, measured by the DSC method, were found to be 5.7 (mJ/mg) and 5.6 (mJ/mg), respectively, to give a ratio of H2/H1=0.98.

Example 2

A [developer 2] of the present invention was obtained in the same manner as in Example 1 except that the fed amount of paraffin wax in the preparation of the dispersion liquid (oil phase) in Example 1 was changed to 5 parts.

The volume average particle size (Dv) and the number average particle size (Dn) of the obtained [toner base 2] were 5.4 μm and 4.9 μm, respectively, and Dv/Dn was 1.10 and the average circularity was 0.971. The peak intensity ratio R of the peak intensity derived from the Pes skeleton (bisphenol derivative) to the peak intensity derived from the releasing agent (ethylene chain), as measured ATR-IR method, was found to be 0.082.

The endothermic amounts H1 and H2 of the releasing agent included in the toner, measured by the DSC method, were found to be 6.6 (mJ/mg) and 6.4 (mJ/mg), respectively, to give a ratio of H2/H1=0.97.

Example 3

A [developer 3] of the present invention was obtained in the same manner as in Example 1 except that the releasing agent in Example 1 was replaced with paraffin wax (melting point: 68° C.). The heating temperature in the heat treatment was set at 76° C. so as to be higher by 8° C. than the melting point of the releasing agent.

The volume average particle size (Dv) and the number average particle size (Dn) of the obtained [toner base 3] were 5.7 μm and 5.1 μm, respectively, and Dv/Dn was 1.12 and the average circularity was 0.974. I The peak intensity ratio R of the peak intensity derived from the Pes skeleton (bisphenol derivative) to the peak intensity derived from the releasing agent (ethylene chain), as measured ATR-IR method, was found to be 0.038.

The endothermic amounts H1 and H2 of the releasing agent included in the toner, measured by the DSC method, were found to be 3.8 (mJ/mg) and 3.7 (mJ/mg), respectively, to give a ratio of H2/H1=0.97.

Example 4

A [developer 4] of the present invention was obtained in the same manner as in Example 3 except that the fed amount of paraffin wax in the preparation of the dispersion liquid (oil phase) in Example 3 was changed to 5 parts.

The volume average particle size (Dv) and the number average particle size (Dn) of the obtained [toner base 4] were 5.2 μm and 4.6 μm, respectively, and Dv/Dn was 1.13 and the average circularity was 0.981. The peak intensity ratio R of the peak intensity derived from the Pes skeleton (bisphenol derivative) to the peak intensity derived from the releasing agent (ethylene chain), as measured ATR-IR method, was found to be 0.059.

The endothermic amounts H1 and H2 of the releasing agent included in the toner, measured by the DSC method, were found to be 4.5 (mJ/mg) and 4.3 (mJ/mg), respectively, to give a ratio of H2/H1=0.96.

Example 5

A [developer 5] of the present invention was obtained in the same manner as in Example 2 except that the releasing agent in Example 2 was replaced with polyethylene wax (melting point: 72° C.).

The volume average particle size (Dv) and the number average particle size (Dn) of the obtained [toner base 5] were 5.6 μm and 4.9 μm, respectively, and Dv/Dn was 1.14 and the average circularity was 0.968. The peak intensity ratio R of the peak intensity derived from the Pes skeleton (bisphenol derivative) to the peak intensity derived from the releasing agent (ethylene chain), as measured ATR-IR method, was found to be 0.093.

The endothermic amounts H1 and H2 of the releasing agent included in the toner, measured by the DSC method, were found to be 6.8 (mJ/mg) and 6.5 (mJ/mg), respectively, to give a ratio of H2/H1=0.96.

Comparative Example 1

A [developer 6] was obtained in the same manner as in Example 1 except that no heat treatment was carried out.

The volume average particle size (Dv) and the number average particle size (Dn) of the obtained [toner base 6] were 5.3 μm and 4.8 μm, respectively, and Dv/Dn was 1.10 and the average circularity was 0.972. The peak intensity ratio R of the peak intensity derived from the Pes skeleton (bisphenol derivative) to the peak intensity derived from the releasing agent (ethylene chain), as measured ATR-IR method, was found to be 0.089.

The endothermic amounts H1 and H2 of the releasing agent included in the toner, measured by the DSC method, were found to be 6.5 (mJ/mg) and 5.7 (mJ/mg), respectively, to give a ratio of H2/H1=0.88.

Comparative Example 2

A [developer 7] was obtained in the same manner as in Example 2 except that no heat treatment was carried out.

The volume average particle size (Dv) and the number average particle size (Dn) of the obtained [toner base 7] were 5.4 μm and 4.9 μm, respectively, and Dv/Dn was 1.10 and the average circularity was 0.970. The peak intensity ratio R of the peak intensity derived from the Pes skeleton (bisphenol derivative) to the peak intensity derived from the releasing agent (ethylene chain), as measured ATR-IR method, was found to be 0.134.

The endothermic amounts H1 and H2 of the releasing agent included in the toner, measured by the DSC method, were found to be 7.8 (mJ/mg) and 6.2 (mJ/mg), respectively, to give a ratio of H2/H1=0.79.

Comparative Example 3

A [developer 8] was obtained in the same manner as in Example 3 except that no heat treatment was carried out.

The volume average particle size (Dv) and the number average particle size (Dn) of the obtained [toner base 8] were 5.7 μm and 5.1 μm, respectively, and Dv/Dn was 1.12 and the average circularity was 0.968. The peak intensity ratio R of the peak intensity derived from the Pes skeleton (bisphenol derivative) to the peak intensity derived from the releasing agent (ethylene chain), as measured ATR-IR method, was found to be 0.102.

The endothermic amounts H1 and H2 of the releasing agent included in the toner, measured by the DSC method, were found to be 4.7 (mJ/mg) and 4.1 (mJ/mg), respectively, to give a ratio of H2/H1=0.87.

Comparative Example 4

A [developer 9] was obtained in the same manner as in Example 2 except that the heating temperature was set at 65° C.

The volume average particle size (Dv) and the number average particle size (Dn) of the obtained [toner base 9] were 5.4 μm and 4.9 μm, respectively, and Dv/Dn was 1.10 and the average circularity was 0.970. The peak intensity ratio R of the peak intensity derived from the Pes skeleton (bisphenol derivative) to the peak intensity derived from the releasing agent (ethylene chain), as measured ATR-IR method, was found to be 0.124.

The endothermic amounts H1 and H2 of the releasing agent included in the toner, measured by the DSC method, were found to be 7.5 (mJ/mg) and 6.4 (mJ/mg), respectively, to give a ratio of H2/H1=0.85.

Comparative Example 5

A [developer 10] was obtained in the same manner as in Example 4 except that the heating temperature was set at 65° C.

The volume average particle size (Dv) and the number average particle size (Dn) of the obtained [toner base 10] were 5.2 μm and 4.6 μm, respectively, and Dv/Dn was 1.13 and the average circularity was 0.979. The peak intensity ratio R of the peak intensity derived from the Pes skeleton (bisphenol derivative) to the peak intensity derived from the releasing agent (ethylene chain), as measured ATR-IR method, was found to be 0.117.

The endothermic amounts H1 and H2 of the releasing agent included in the toner, measured by the DSC method, were found to be 5.8 (mJ/mg) and 4.4 (mJ/mg), respectively, to give a ratio of H2/H1=0.76.

The properties and the evaluation results of the developers are shown in Tables 1 and 2.

As can be seen from Tables, the developers according to Examples of the present invention provided extremely satisfactory results. By contrast, the developers of Comparative Examples that were not subjected to heat treatment at temperatures equal to or higher than the melting point of the releasing agent particularly stained the developing members in the durability test and caused the generation of longitudinal scratches in the image, significantly reducing the toner charge amount.

TABLE 1

| | | Releasing agent | | | Toner particle | | | | DSC | ATR-IR | DSC | |
|---|---|---|---|---|---|---|---|---|---|---|---|---|
| | | Melting | | | size | | | Shape | Endothermic | Intensity | | H2/ |
| | Developer | point (° C.) | Content (parts) | Heat treatment | Dv | Dn | Dv/Dn | Circularity | amount H | ratio R | H2 | H1 |
| Example 1 | 1 | 72 | 4 | 80° C. | 5.3 | 4.8 | 1.10 | 0.975 | 5.7 | 0.043 | 5.6 | 0.98 |
| Example 2 | 2 | 72 | 5 | 80° C. | 5.4 | 4.9 | 1.10 | 0.971 | 6.6 | 0.082 | 6.4 | 0.97 |
| Example 3 | 3 | 68 | 4 | 76° C. | 5.7 | 5.1 | 1.12 | 0.974 | 3.8 | 0.038 | 3.7 | 0.97 |
| Example 4 | 4 | 68 | 5 | 76° C. | 5.2 | 4.6 | 1.13 | 0.981 | 4.5 | 0.059 | 4.3 | 0.96 |
| Example 5 | 5 | 72 | 5 | 80° C. | 5.6 | 4.9 | 1.14 | 0.968 | 6.8 | 0.093 | 6.5 | 0.96 |
| Comparative Example 1 | 6 | 72 | 4 | None | 5.3 | 4.8 | 1.10 | 0.972 | 6.5 | 0.089 | 5.7 | 0.88 |
| Comparative Example 2 | 7 | 72 | 5 | None | 5.4 | 4.9 | 1.10 | 0.970 | 7.8 | 0.134 | 6.2 | 0.79 |
| Comparative Example 3 | 8 | 68 | 4 | None | 5.7 | 5.1 | 1.12 | 0.968 | 4.7 | 0.102 | 4.1 | 0.87 |
| Comparative Example 4 | 9 | 72 | 5 | 65° C. | 5.4 | 4.9 | 1.10 | 0.970 | 7.5 | 0.124 | 6.4 | 0.85 |
| Comparative Example 5 | 10 | 68 | 5 | 65° C. | 5.2 | 4.6 | 1.13 | 0.979 | 5.8 | 0.117 | 4.4 | 0.76 |

TABLE 2

| | | Evaluation results | | | | | |
|---|---|---|---|---|---|---|---|
| | Developer | Chargeability | Image staining | Anti-stress property | Transferability | Fixing OW | Heat-resistance/ storage stability |
| Example 1 | 1 | A | A | A | A | B | A |
| Example 2 | 2 | B | A | A | B | A | B |
| Example 3 | 3 | A | A | A | A | B | A |

TABLE 2-continued

| | | Evaluation results | | | | | |
|---|---|---|---|---|---|---|---|
| | Developer | Chargeability | Image staining | Anti-stress property | Transferability | Fixing OW | Heat-resistance/ storage stability |
| Example 4 | 4 | A | B | B | A | A | B |
| Example 5 | 5 | B | A | A | B | B | A |
| Comparative Example 1 | 6 | B | B | C | C | B | C |
| Comparative Example 2 | 7 | C | D | D | D | A | C |
| Comparative Example 3 | 8 | B | C | D | D | A | D |
| Comparative Example 4 | 9 | B | C | C | A | A | C |
| Comparative Example 5 | 10 | B | C | C | A | A | D |

What is claimed is:

1. A toner production method comprising:

dispersing in an aqueous medium an organic dispersion liquid that comprises in an organic solvent a pigment, a binder resin and/or a binder resin precursor, and a releasing agent;

removing the organic solvent to prepare a dispersion slurry in which toner particles are dispersed in the aqueous medium including a surfactant;

heating the dispersion slurry to a temperature in a range from the melting point of the releasing agent to 80° C. so that the releasing agent exposed to a surface of the toner particles is melted to be separated into the aqueous medium; and washing the toner particles.

2. The toner production method according to claim 1, wherein the surfactant is one of a monovalent anionic surfactant and a divalent anionic surfactant.

3. The toner production method according to claim 1, wherein the releasing agent is one of a paraffin wax and a polyethylene wax.

4. The toner production method according to claim 1, wherein the binder resin comprises two or more different binder resins, and comprises a modified polyester resin comprising urethane or/and urea groups.

5. The toner production method according to claim 4, wherein the polyester resin comprises a modified polyester resin component extended in chain length or/and crosslinked by a reaction of an amine and a modified polyester resin having an isocyanate group at a terminal thereof.

* * * * *